US011311894B2

(12) United States Patent
Lin et al.

(10) Patent No.: US 11,311,894 B2
(45) Date of Patent: Apr. 26, 2022

(54) WATER OUTLET STRUCTURE FOR ATOMIZED PARTICLE WATER AND SHOWER

(71) Applicant: Xiamen Solex High-Tech Industries Co., Ltd., Xiamen (CN)

(72) Inventors: Fengde Lin, Xiamen (CN); Shilong Wu, Xiamen (CN); Donghai Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 0 days.

(21) Appl. No.: 17/026,809

(22) Filed: Sep. 21, 2020

(65) Prior Publication Data

US 2021/0086206 A1 Mar. 25, 2021

(30) Foreign Application Priority Data

Sep. 20, 2019 (CN) ..... 201910892914.6
Sep. 27, 2019 (CN) ..... 201910927553.4

(51) Int. Cl.

*B05B 1/18* (2006.01)
*B05B 1/02* (2006.01)
*B05B 1/34* (2006.01)

(52) U.S. Cl.

CPC ..... *B05B 1/185* (2013.01); *B05B 1/02* (2013.01); *B05B 1/341* (2013.01)

(58) Field of Classification Search

CPC ..... B05B 1/185; B05B 1/02; B05B 1/341
USPC ..... 239/466–468, 500, 558
See application file for complete search history.

(56) References Cited

U.S. PATENT DOCUMENTS 8,967,498 B2 * 3/2015 Egli ..... B05B 1/3431 239/490

* cited by examiner

*Primary Examiner* — Christopher S Kim
(74) *Attorney, Agent, or Firm* — Cooper Legal Group, LLC

(57) ABSTRACT

A water outlet structure for fine-gentle atomized particle water comprises a water inlet cavity, a first arc acceleration track, a side flushing cavity, a second arc acceleration track, and a water outlet hole. A first end of the first arc acceleration track is connected to a side wall of the water inlet cavity, a second end of the first arc acceleration track is connected to a first end of the side flushing cavity, and a second end of the side flushing cavity is connected to the second arc acceleration track. The water outlet hole is disposed on a circle center of the second arc acceleration track. The present disclosure further provides a shower and a kitchen shower comprising the water outlet structure.

12 Claims, 9 Drawing Sheets

WATER OUTLET STRUCTURE FOR ATOMIZED PARTICLE WATER AND SHOWER

RELATED APPLICATIONS

This application claims priority to Chinese patent application number 201910892914.6, filed on Sep. 20, 2019, and Chinese patent application number 201910927553.4, filed on Sep. 27, 2019. Chinese patent application number 201910892914.6 and Chinese patent application number 201910927553.4 are incorporated herein by reference.

FIELD OF THE DISCLOSURE

The present disclosure relates to the field of household bathroom fixtures, and more particularly relates to a water outlet structure.

BACKGROUND OF THE DISCLOSURE

Water outlet structures on the market today generally need a direction diverter added at a water outlet end of the water outlet structures to define a vortex rotating water spray pattern to enable the water outlet structures to product atomized water. N nozzles require N direction diverters. The assembly process is complicated and the cost is relatively high. Moreover, gaps between each of the direction diverters and a cover are inconsistent, resulting in inconsistent water spray patterns.

BRIEF SUMMARY OF THE DISCLOSURE

The main technical problem of the present disclosure to be resolved is to provide a water outlet structure for fine-gentle atomized particle water to further enrich types and functions of water spray patterns.

In order to solve the aforementioned technical problem, the present disclosure provides a water outlet structure for fine-gentle atomized particle water. The water outlet structure for fine-gentle atomized particle water comprises a water inlet cavity, a first arc acceleration track, a side flushing cavity, a second arc acceleration track, and a water outlet hole. A first end of the first arc acceleration track is connected to a side wall of the water inlet cavity, a second end of the first arc acceleration track is connected to a first end of the side flushing cavity, and a second end of the side flushing cavity is connected to the second arc acceleration track. The water outlet hole is disposed on a circle center of the second arc acceleration track. The water flows into the water inlet cavity and then flows into the first arc acceleration track and is accelerated by the first arc acceleration track to define accelerated particle water. The accelerated particle water collides with a side wall of the side flushing cavity to define refined particle water. The refined particle water flows into the second arc acceleration track and is accelerated by the second arc acceleration track to define rotating refined particle water. The rotating refined particle water then flows out of the water outlet hole.

In a preferred embodiment, the water inlet cavity defines a straight flushing cavity, and the water collides with a bottom wall of the straight flushing cavity to define particle water.

In a preferred embodiment, after the rotating refined particle water passes through the water outlet hole, a centrifugal force between the rotating refined particle water is larger (i.e., far lager) than a surface tension of the water.

In a preferred embodiment, the side flushing cavity is tangent to the second arc acceleration track.

The present disclosure further provides a shower. The shower comprises a body, a water dividing body, and a cover. The cover is disposed with a plurality of the water outlet structures for the fine-gentle atomized particle water.

In a preferred embodiment, the plurality of the water outlet structures for fine-gentle atomized particle water are arranged in a circular ring, and an inner side and an outer side of the circular ring are respectively disposed with ordinary water outlet nozzles.

In a preferred embodiment, the water dividing body enables water to flow out of the plurality of the water outlet structures or water to mixedly flow out of the plurality of the water outlet structures and the ordinary water outlet nozzles.

The present disclosure further provides a kitchen shower. The kitchen shower comprises a kitchen shower body, and a water outlet cover. The water outlet cover is disposed with a plurality of the water outlet structures for the fine-gentle atomized particle water.

In a preferred embodiment, the plurality of the water outlet structures are arranged in a circular ring, and an inner side of the circular ring is disposed with an aerator.

Compared with the existing techniques, the technical solution has the following advantages.

1. The present disclosure provides a water outlet structure for fine-gentle atomized particle water. After the water of water inlet cavity flows into the first arc acceleration track, the water is accelerated by the first arc acceleration track to define the accelerated particle water. The accelerated particle water collides the side wall of the side flushing cavity to define the refined particle water and enters the second arc acceleration track to be accelerated by the second arc acceleration track to define rotating refined particle water. The rotating refined particle water then flow out of the water outlet hole to define gentle atomized particle water. This very fine and very gentle water spray is very suitable for beauty care and facial cleaning. Therefore, after this water outlet structure is installed, the water spray patterns and the water spray functions of the shower can be further enriched.

2. The present disclosure provides a water outlet structure for fine-gentle atomized particle water that creates fine-gentle atomized water without using a direction diverter. The cover only requires a special cross-section of the track to be welded to the water dividing body to define the fine-gentle atomized water, the cost is low, and a process is stable.

DETAILED DESCRIPTION OF THE EMBODIMENTS

Figure 1:
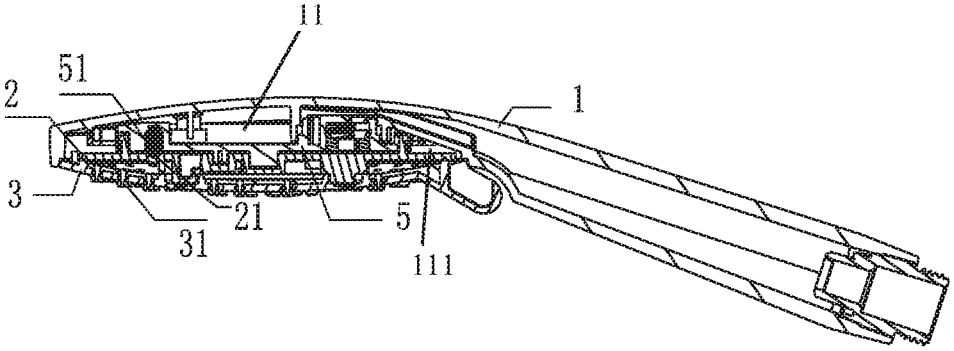
FIG. 1 is a cross-sectional view of a shower of Embodiment 1 of the present disclosure.
Figure 2:
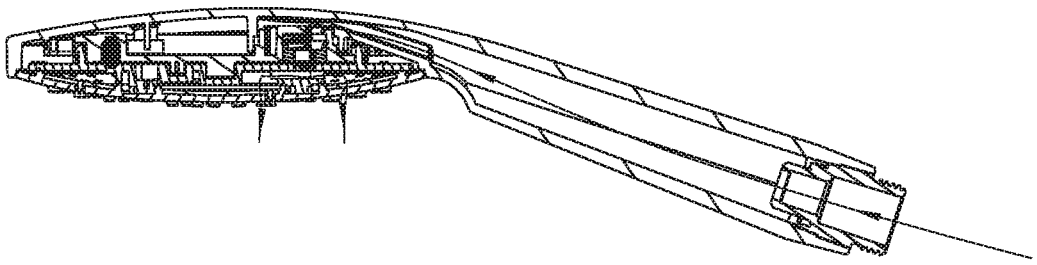
FIG. 2 is a cross-sectional view of a first water passage of the shower when discharging ordinary water of Embodiment 1 of the present disclosure.
Figure 3:
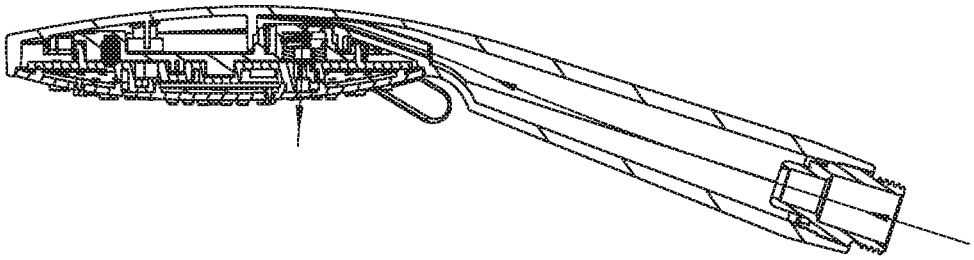
FIG. 3 is a cross-sectional view of a second water passage of the shower when discharging atomized water of Embodiment 1 of the present disclosure.
Figure 4:
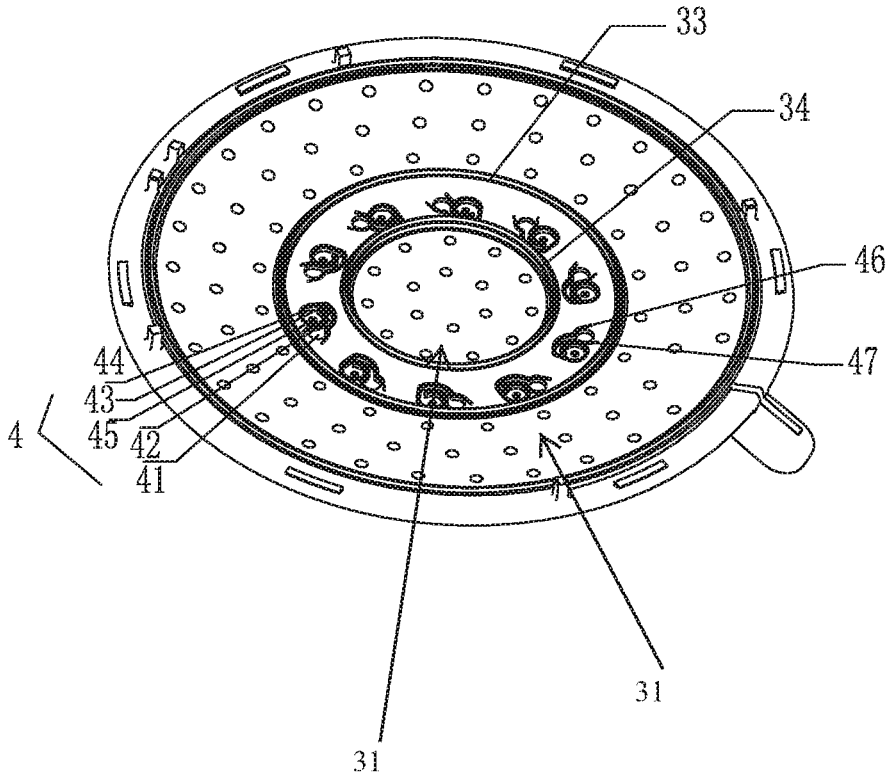
FIG. 4 is a perspective view of a shower cover of Embodiment 1 of the present disclosure.

The present disclosure will be further described below in combination with the accompanying drawings and embodiments. However, the present disclosure is not limited thereto.

Embodiment 1

Referring to FIGS. 1-4, the present disclosure provides a shower. The shower comprises a body 1, a water dividing body 2 (i.e., a water outlet switching structure), and a cover 3. The cover 3 is disposed with one or more water outlet structures 4 for fine-gentle atomized particle water.

The body 1 comprises a cavity 11 comprising a downward opening 111. A fixed seat 5 is disposed in the cavity 11, and a lower surface of the fixed seat 5 is connected to a positioning pin 51 through a spring. The water dividing body 2 is fixedly connected to the cover 3 and is disposed on a lower side of the fixed seat 5 to block the downward opening 111 of the cavity 11. The water dividing body 2 comprises three positioning holes 21. When the cover 3 drives the water dividing body 2 to rotate, the positioning pin 51 cooperates with one of the three positioning holes 21 to enable water from a handle of the body 1 to flow into the cavity 11, then flow out of different portions of the water dividing body 2, and then flow to different regions of the cover 3 to define different water spray patterns.

The one or more water outlet structures 4 for the fine-gentle atomized particle water of the cover 3 are arranged in a circular ring, and an outer side and an inner side of the circular ring are respectively disposed with ordinary water outlet nozzles 31. Therefore, when the positioning pin 51 rotates to be switched in the three positioning holes 21, the water spray patterns change accordingly. Three water spray patterns comprises: 1) an ordinary water discharging from the ordinary water outlet nozzles 31 disposed on the inner side and the outer side of the one or more water outlet structures 4 for the fine-gentle atomized particle water, 2) a mixed water discharging from the ordinary water outlet nozzles 31 disposed on the inner side and the outer side of the one or more water outlet structures 4 for the fine-gentle atomized particle water and discharging from the one or more water outlet structures 4 for the fine-gentle atomized particle water, and 3) an atomized water separately discharging from the one or more water outlet structures 4 for the fine-gentle atomized particle water.

Figure 5:
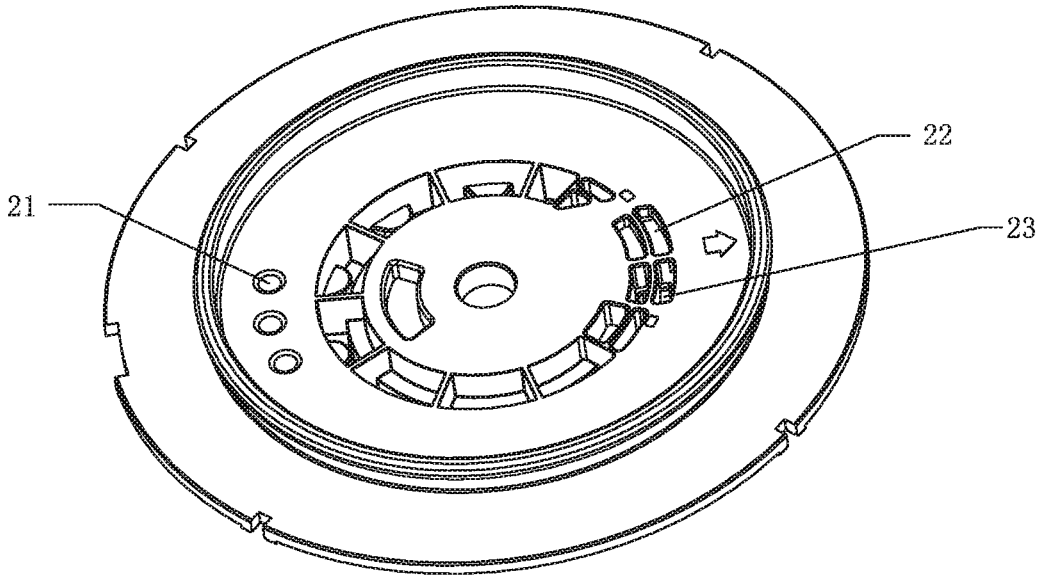
FIG. 5 is a front perspective view of a water dividing body of Embodiment 1 of the present disclosure.
Figure 6:
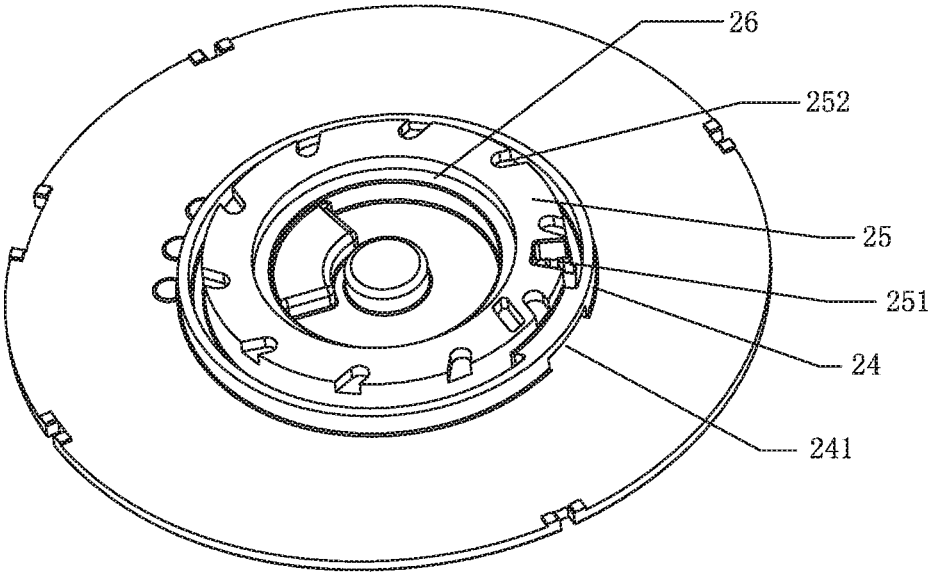
FIG. 6 is a rear perspective view of the water dividing body of Embodiment 1 of the present disclosure.

Referring to FIGS. 5 and 6, the specific structure of the water dividing body 2 in this embodiment is as follows. A front surface of the water dividing body 2 is disposed with the three positioning holes 21 and is further disposed with a water dividing hole 22 for inner-outer annular shower water and a water dividing hole 23 for atomization beauty care.

In order to introduce the water in the water dividing hole 23 for atomization beauty care to each of the one or more water outlet structures 4 for fine-gentle atomized particle water, a rear portion of the water dividing body 2 comprises a first protrusion platform 24, a second protrusion platform 25, and a third protrusion platform 26 disposed in an inward direction in series. A height of the second protrusion platform 25 disposed in the first protrusion platform 24 is higher than a height of the first protrusion platform 24 and a height of the third protrusion platform 26. A side of the cover 3 facing the water dividing body 2 comprises a first protrusion 33 and a second protrusion 34 configured to abut and cooperate with the first protrusion platform 24 and the third protrusion platform 26 (i.e., the first protrusion 33 is configured to abut and cooperate with the first protrusion platform 24, and the second protrusion 34 is configured to abut and cooperate with the third protrusion platform 26). The one or more water outlet structures 4 are disposed between the first protrusion 33 and the second protrusion 34. In this way, when the cover 3 is assembled to the water dividing body 2, the first protrusion 33 and the second protrusion 34 abut the first protrusion platform 24 and the third protrusion platform 26 (i.e., the first protrusion 33 abuts the first protrusion platform 24, and the second protrusion 34 abuts the third protrusion platform 26), so that the ordinary water outlet nozzles 31 disposed on an inner ring and an outer ring of the cover 3 (i.e., the outer side and the inner side of the circular ring) are separated from the one or more water outlet structures 4 for the fine-gentle atomized particle water. The second protrusion platform 25 is further disposed with a water outlet 251 for atomization beauty care directly connected to the water dividing hole 23 for atomization beauty care, and a plurality of water inlets 252 for atomization beauty care are also disposed on the second protrusion platform 25 in a circumferential direction of the second protrusion platform 25. Moreover, a periphery of each of the one or more water outlet structures 4 is disposed with a third protrusion 46 and a fourth protrusion 47, and the third protrusion 46 and the fourth protrusion 47 cooperate with the second protrusion platform 25 to define a water inlet cavity 41. When water flows from the water dividing hole 23 for atomization beauty care and flows out of the water outlet 251 for atomization beauty care, due to the first protrusion platform 24 and the third protrusion platform 26 being blocked, and also due to the third protrusion 46, the fourth protrusion 47, and the second protrusion platform 25 define the water inlet cavity 41. Water can only flow into the one or more water outlet structures 4 from the water inlet 252 for atomization beauty care and then flow out of each of the one or more water outlet structures 4 for fine-gentle atomized particle water to define the atomized water.

In order to introduce the water from the water dividing hole 22 for inner-outer annular shower water to the ordinary water outlet nozzles 31 disposed on the inner ring and the ordinary water outlet nozzles 31 disposed on the outer ring concurrently, a side surface of the first protrusion platform 24 comprises a through opening 241. The through opening 241 extends inward radially and is in communication with a side wall of the third protrusion platform 26, and the through opening 241 is also in communication with the water dividing hole 22 for inner-outer annular shower water. In this way, after the water flows out of the water dividing hole 22 for inner-outer annular shower water, a portion of the water flows outward radially through a side wall of the first protrusion platform 24, and another portion of the water flows inward radially through the side wall of the third protrusion platform 26 to enable the water to flow out of the ordinary water outlet nozzles 31 disposed on the inner ring and the ordinary water outlet nozzles 31 disposed on the outer ring concurrently. Each of the one or more water outlet structures 4 for fine-gentle atomized particle water comprises the water inlet cavity 41, a first arc acceleration track 42, a side flushing cavity 43, a second arc acceleration track 44, and a water outlet hole 45.

One end of the first arc acceleration track 42 is connected to (i.e., in communication with) a side wall of the water inlet cavity 41, and the other end of the first arc acceleration track 42 is connected to (i.e., in communication with) one end of the side flushing cavity 43. The other end of the side flushing cavity 43 is in communication with the second arc acceleration track 44. The water outlet hole 45 is disposed on a center (i.e., a circle center) of the second arc acceleration track 44.

The water from the plurality of water inlets 252 for atomization beauty care flows into the water inlet cavities 41 and is accelerated by the first arc acceleration tracks 42. The accelerated particle water collides with a side wall of the side flushing cavities 43 to define refined particle water, flows into the second arc acceleration tracks 44 to be accelerated to define rotating refined particle water, and then flows out of the water outlet holes 45. Thereby, a water outflow effect of the fine-gentle atomized particle water is achieved. This very fine and very gentle water spray is very suitable for beauty care and facial cleaning. Therefore, after this water outlet structure is installed, the water spray patterns and water spray functions of the shower can be further enriched.

In some embodiments, the water inlet cavities 41 define straight flushing cavities. The water inlet cavities 41 are disposed right below the plurality of water inlets 252 for atomization beauty care, so that the water flowing from the plurality of water inlets 252 for atomization beauty care collides with bottom walls of the water inlet cavities 41 to define particle water and then enters the first arc acceleration tracks 42 to be accelerated.

The aforementioned structure creates fine-gentle atomized water without using a direction diverter, the cover 3 only requires a special cross-section of the track to be welded to the water dividing body 2 to define the fine-gentle atomized water, the cost is low, and a process is stable.

In this embodiment, after the rotating refined particle water passes through the water outlet holes 45, a centrifugal force between the particle water is far greater than a surface tension of the water. Therefore, the particle water can be separated as much as possible, and particle effect is very significant.

In this embodiment, in order to achieve the rotating refined particle water, the side flushing cavity 43 is tangent to the second arc acceleration track 44.

Embodiment 2

Figure 7:
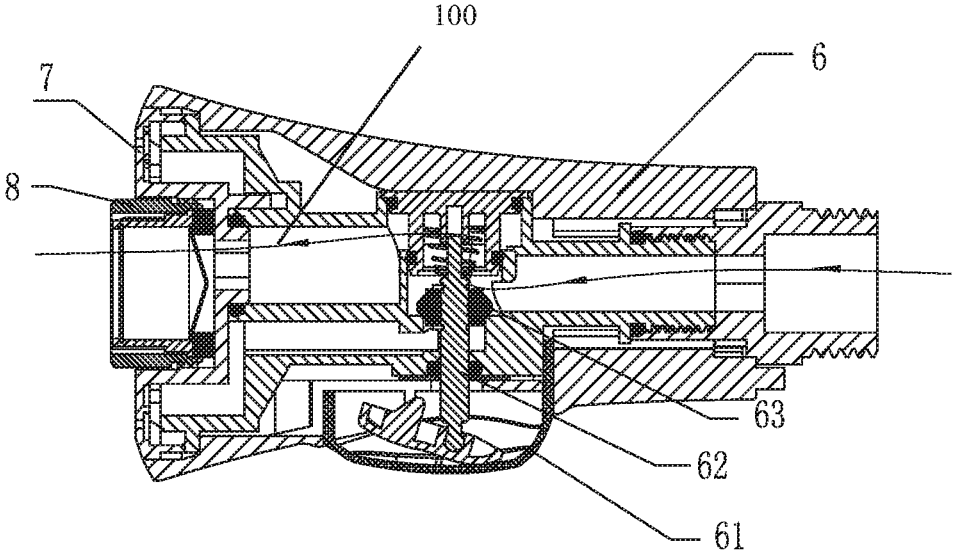
FIG. 7 is a cross-sectional view of a first water passage of a kitchen shower when discharging aerated water of Embodiment 2 of the present disclosure.
Figure 8:
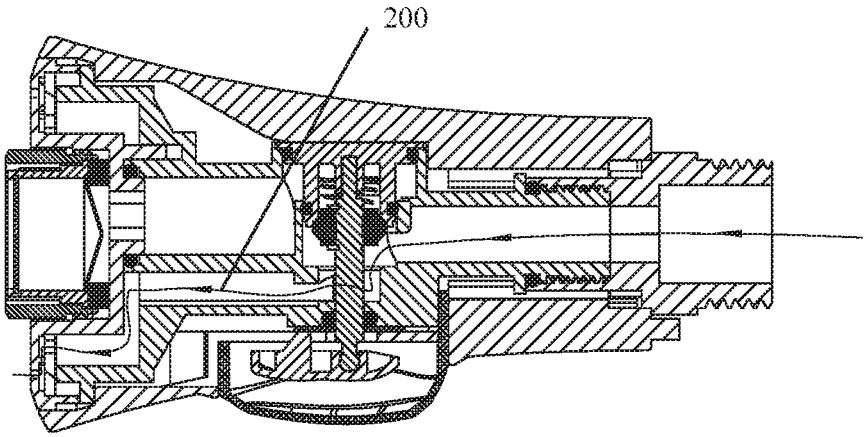
FIG. 8 is a cross-sectional view of a second water passage of the kitchen shower when discharging atomized water of Embodiment 2 of the present disclosure.
Figure 9:
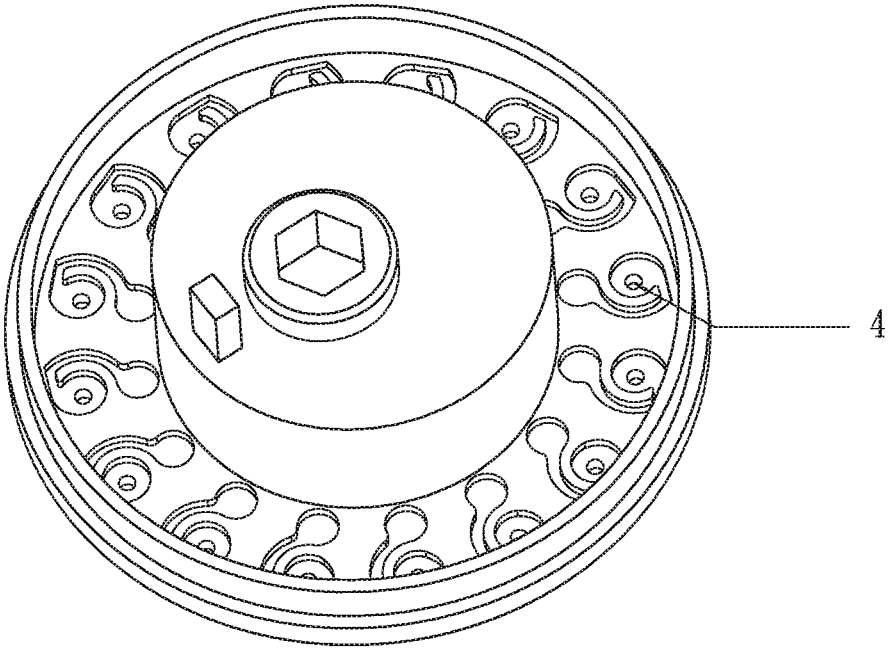
FIG. 9 is a perspective view of a kitchen shower cover of Embodiment 2 of the present disclosure.

Referring to FIGS. 7-9, the present disclosure also provides a kitchen shower. The kitchen shower comprises a kitchen shower body 6 and a water outlet cover 7. The water outlet cover 7 is disposed with the one or more water outlet structures 4 for the fine-gentle atomized particle water of Embodiment 1.

In this embodiment, the one or more water outlet structures 4 for the fine-gentle atomized particle water are arranged in a circular ring, and an inner side of the circular ring (i.e., a circular ring area) is disposed with an aerator 8.

The kitchen shower body 6 is disposed with a button 61, and the button 61 is operatively connected to a push rod 62. The push rod 62 is disposed with a seal ring 63. By pushing the button 61, the push rod 62 can be driven to move upward and downward to enable the sealing ring 63 to respectively open and to close different ones of a first water passage 100 and a second water passage 200. Therefore, a switching between aerated water and the fine-gentle atomized particle water is achieved.

It will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A water outlet structure for atomized particle-shaped water, comprising:
- a water inlet cavity,
- a first arc-shaped acceleration track,
- a side flushing cavity,
- a second arc-shaped acceleration track, and
- a water outlet hole, wherein:
  - a first end of the first arc-shaped acceleration track is connected to a side wall of the water inlet cavity,
  - a second end of the first arc-shaped acceleration track is connected to a first end of the side flushing cavity,
  - a second end of the side flushing cavity is connected to the second arc-shaped acceleration track,
  - the water outlet hole is disposed on a circle center of the second arc-shaped acceleration track,
    - water flows into the water inlet cavity and then flows into the first arc-shaped acceleration track and is accelerated by the first arc-shaped acceleration track to define accelerated particle-shaped water,
  - the accelerated particle-shaped water collides with a side wall of the side flushing cavity to define refined particle-shaped water,
  - the side wall of the side flushing cavity lies in a plane facing an outlet of the first arc-shaped acceleration track,
  - the side wall of the side flushing cavity is connected to a side wall of the first arc-shaped acceleration track to define an angle,
  - the refined particle-shaped water flows into the second arc-shaped acceleration track and is accelerated by the second arc-shaped acceleration track to define rotating refined particle-shaped water, and
  - the rotating refined particle-shaped water flows out of the water outlet hole.

2. The water outlet structure for the atomized particle-shaped water according to claim 1, wherein:
- the water inlet cavity defines a straight flushing cavity,
- the water collides with a bottom wall of the straight flushing cavity to define particle-shaped water, and
- the water that flows into the first arc-shaped acceleration track and is accelerated by the first arc-shaped acceleration track to define the accelerated particle-shaped water from the particle-shaped water.

3. The water outlet structure for the atomized particle-shaped water according to claim 1, wherein:
- after the rotating refined particle-shaped water passes through the water outlet hole, a centrifugal force of the rotating refined particle-shaped water is larger than a surface tension of the rotating refined particle-shaped water.

4. The water outlet structure for the atomized particle-shaped water according to claim 1, wherein the side flushing cavity is tangent to the second arc-shaped acceleration track.

5. A shower, comprising:
- a body,
- a water dividing body, and
- a cover, wherein:

the cover is disposed with the water outlet structure for the atomized particle-shaped water according to claim 1.

6. The shower according to claim 5, wherein:

the water outlet structure for atomized particle-shaped water and a plurality of other water outlet structures are arranged in a circular ring, and an inner side and an outer side of the circular ring are respectively disposed with water outlet nozzles.

7. The shower according to claim 6, wherein:

the water dividing body enables the rotating refined particle-shaped water to flow out of the water outlet structure and the plurality of other water outlet structures or the rotating refined particle-shaped water to mixedly flow out of the water outlet structure, the plurality of other water outlet structures, and the water outlet nozzles.

8. The water outlet structure for the atomized particle-shaped water according to claim 1, wherein the water inlet cavity, the first arc-shaped acceleration track, the side flushing cavity, the second arc-shaped acceleration track, and the water outlet hole integrally define the water outlet structure.

9. The water outlet structure for the atomized particle-shaped water according to claim 1, wherein the first arc-shaped acceleration track encompasses the second arc-shaped acceleration track.

10. The water outlet structure for the atomized particle-shaped water according to claim 1, wherein a water flow direction of the first arc-shaped acceleration track and a water flow direction of the second arc-shaped acceleration track are concentric.

11. The water outlet structure for the atomized particle-shaped water according to claim 1, wherein the plane is disposed on a tangential line of the second arc-shaped acceleration track.

12. The water outlet structure for the atomized particle-shaped water according to claim 1, wherein the side wall of the first arc-shaped acceleration track faces a center of the first arc-shaped acceleration track.

* * * * *